US006449893B2

(12) United States Patent
Spinner

(10) Patent No.: US 6,449,893 B2
(45) Date of Patent: Sep. 17, 2002

(54) MOUNTING APPARATUS

(75) Inventor: Gerd Spinner, Obernodorf-Bochingen (DE)

(73) Assignee: Heckler & Koch GmbH, Obernoderf/Neckar (DE)

( * ) Notice: Subject to any disclaimer, the term of this patent is extended or adjusted under 35 U.S.C. 154(b) by 0 days.

(21) Appl. No.: 09/747,587

(22) Filed: Dec. 22, 2000

Related U.S. Application Data

(63) Continuation of application No. PCT/EP00/03601, filed on Apr. 20, 2000.

(30) Foreign Application Priority Data

Apr. 23, 1999 (DE) ..... 199 18 635

(51) Int. Cl.[7] ..... F41G 1/38

(52) U.S. Cl. ..... 42/127; 42/124; 42/125; 42/126

(58) Field of Search ..... 42/124, 125, 126, 42/119, 127, 128; 89/41.19

(56) References Cited

U.S. PATENT DOCUMENTS

| | | | | |
|---|---|---|---|---|
| 3,107,450 A | | 10/1963 | Snyder et al. | 42/786 |
| 3,835,565 A | | 9/1974 | Weast | 42/1 S |
| 3,986,285 A | | 10/1976 | Krisay | 42/1 ST |
| 4,383,371 A | * | 5/1983 | Coffey | |
| 4,905,396 A | * | 3/1990 | Bechtel | |
| D308,089 S | * | 5/1990 | Sanders | |
| 5,155,915 A | * | 10/1992 | Repa | |
| 5,680,725 A | * | 10/1997 | Bell | |
| 5,926,964 A | * | 7/1999 | Korapaty | |
| 6,026,580 A | * | 2/2000 | LaRue | |
| 6,295,754 B1 | * | 10/2001 | Otteman et al. | |

FOREIGN PATENT DOCUMENTS

| | | | |
|---|---|---|---|
| DE | 199957 | 6/1908 | |
| DE | 1 008 615 | 5/1957 | |
| DE | 1 256 113 | 12/1967 | |
| DE | 85 10 245.8 | 8/1985 | F41G/1/38 |
| DE | 41 33 932 A1 | 4/1993 | F41G/1/387 |
| DE | 44 44 677 C1 | 2/1996 | F41G/1/387 |
| WO | WO8807168 * | 9/1988 | |

OTHER PUBLICATIONS

English translation of abstract of German Patent No. DE 199 957.

English translation of abstract of German Patent No. DE 1 008 615.

English translation of abstract of German Patent No. DE 1 256 113.

English translation of abstract of German Patent No. DE 85 10 245.8.

* cited by examiner

*Primary Examiner*—Charles T. Jordan
*Assistant Examiner*—Troy Chambers
(74) *Attorney, Agent, or Firm*—Marshall, Gerstein & Borun

(57) ABSTRACT

A mounting apparatus is disclosed for attaching a sighting device onto a weapon. The mounting apparatus has a rail disposed on part of the weapon in a longitudinal direction. The rail has a pair of longitudinally extending opposed sides and a longitudinally extending first attachment element on each of the opposed sides. A removable mounting base has a pair of longitudinally extending side edges and a longitudinally extending second attachment element on each side edge. Each second attachment element is complimentary to a corresponding one of the first attachment elements. The mounting base is slidingly and longitudinally engaged with the rail via the complimentary first and second attachment elements. The mounting base is formed of at least two parts which are slidable against one another in a transverse direction. A spring mechanism produces a spring force and is arranged to bias the two parts of the mounting base into engagement with the rail. The spring force is overcome by manually squeezing the two parts to release the mounting base from the rail.

13 Claims, 2 Drawing Sheets

MOUNTING APPARATUS

RELATED APPLICATION

This patent is a continuing application claiming priority from related copending international application Ser. No. PCT/EP00/03601, filed on Apr. 20, 2000.

FIELD OF THE INVENTION

The present invention relates generally to barreled weaponry, and more particularly to a mounting apparatus for installing a telescopic sight or the like on such a barreled weapon.

BACKGROUND OF THE INVENTION

There are a great many types of mounting apparatuses for the adjustable securement of telescopic sights and the like on weapons. In all, the common basic endeavor is to fasten the mounted telescopic sight securely, so that its relative positioning with the weapon is maintained.

Expensive hunting weapons mostly employ mounting apparatuses which are custom-made by hand, and which possess very precise and complex surfaces. Where sport weapons and military weapons are concerned, on the other hand, preference is given mostly to more simple and robust mounting apparatuses, which revert to the basic form of the so-called insertion types.

In the case of such an insertion mounting, on the weapon itself, a rail with a dovetail recess is installed or integrally designed thereon. A removable foot or a mounting base with a complementary profile is employed on the sighting device which permits a sliding engagement on the rail with little play.

The rail can be placed on the upper side of the weapon so that its surface at normal firing position runs horizontally. This can, however, be installed on the side of the weapon, so that at normal firing position the surface runs vertically. The rail may be installed at other positions and then coupled with the weapon, such as in the case of a vehicular MG-gun mount. The length of the rail need be only a few centimeters. On the other hand, it can be significantly longer.

A clamping device, such as a set screw in a simple version, penetrates through the mounting base and serves the purpose of affixing this securely to the dove excision of the rail. The shaft of the set screw, when this is done, is arranged in such a manner between the mounting base and the rail that the position of the sighting device in the axial direction of the weapon is always reliably reproducible. Such a mounting apparatus is disclosed in U.S. Pat. No. 3,887,166 (Ward). This known mounting apparatus is advantageous because it is compactly made and of small size. The disadvantage lies in a complicated insertion procedure and in discovering the proper fastening position, as well as in the necessarily high level of precision required to manufacture the Ward apparatus.

It is also possible to subdivide the mounting base longitudinally and to move a first part relative to a second part out of engagement with the rail. In this case, the mounting base must not be thrust in an axial direction to engage the rail, but can be affixed on the rail at an optional position by means of displaceable parts. When these parts return into their original positions, they then engage the rail and clamp securely. Such a mounting apparatus is disclosed in European Patent document No. EP 0 444 300 A2 (Repa). In Repa, a longer, off-center linked lever is shown. The lever, proximal to its end, is pivotably fastened on a part of the mounting base.

The short end of the pivoting lever is connected to the other part of the mounting base by means of a knee-linkage mechanism, which allows this other part to press with considerable force from the outside against the rail, that is, in a direction contrary to the first part. Since the knee-linked lever mechanism is bent when idle, it exercises a force in the direction of a reverse movement of the movable part.

BRIEF DESCRIPTION OF THE DRAWINGS

An exemplary apparatus constructed in accordance with the teachings of the invention is described and explained in greater detail below with the aid of the drawing figures in which.

DETAILED DESCRIPTION OF THE PREFERRED EMBODIMENTS

Figure 1:
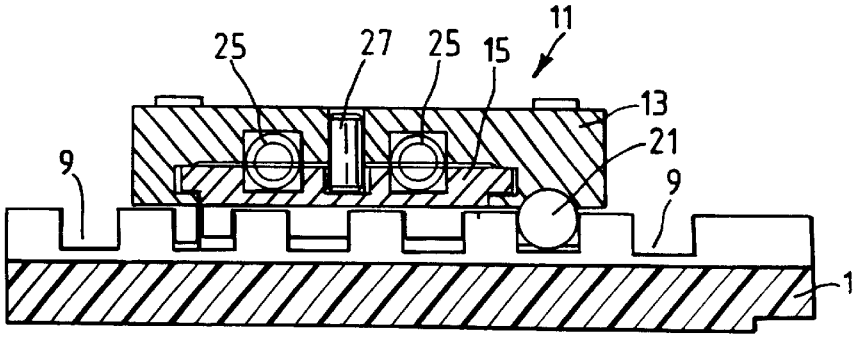
FIG. 1 is a longitudinal section through a mounting apparatus constructed in accordance with the teachings of the invention wherein a telescopic sight, or the like, which is to be carried on the mounting base, has been omitted for clarity of illustration.
Figure 2:
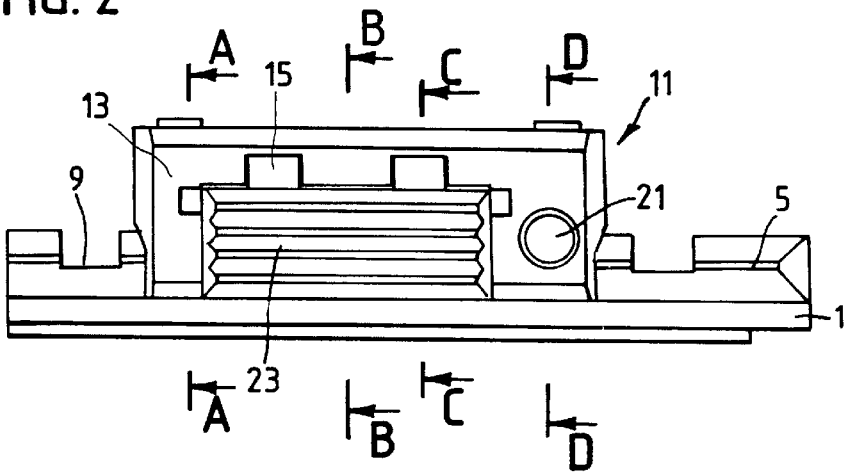
FIG. 2 is a side view of the mounting apparatus of FIG. 1, as viewed from the "Z" axis reference point, wherein the X, Y and Z axes are shown FIG. 8.
Figure 3:
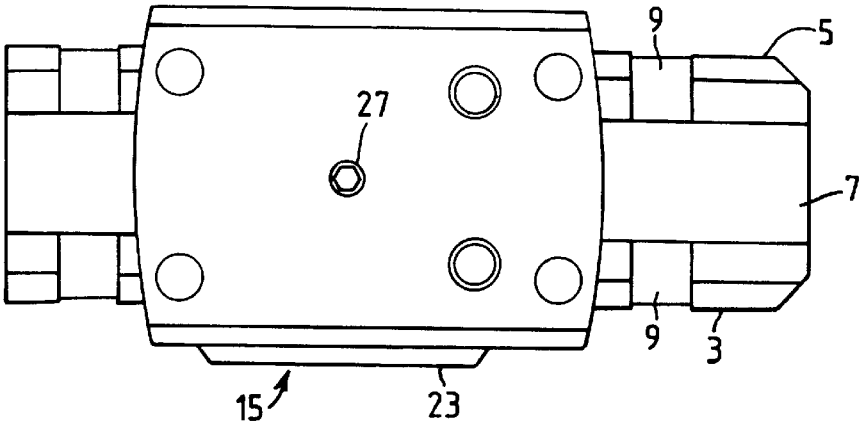
FIG. 3 is a top view on the mounting apparatus of FIG. 1.
Figure 4:
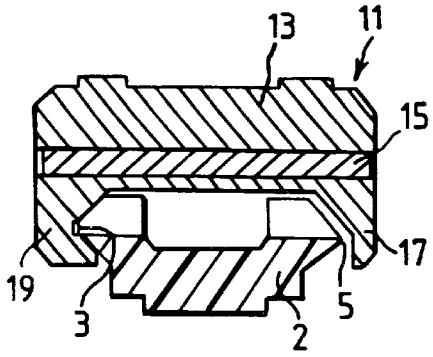
FIG. 4 is a section taken along line A—A of FIG. 2.
Figure 5:
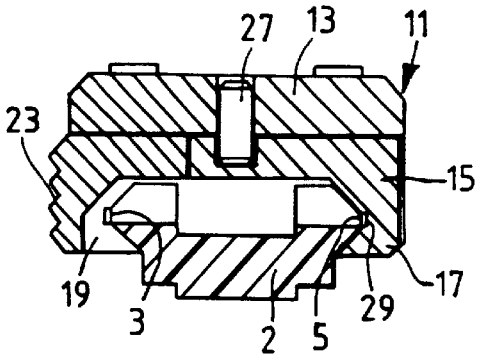
FIG. 5 is a section taken along line B—B of FIG. 2.
Figure 6:
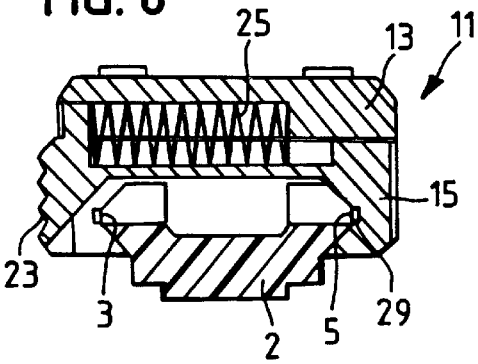
FIG. 6 is a section taken along line C—C of FIG. 2.
Figure 7:
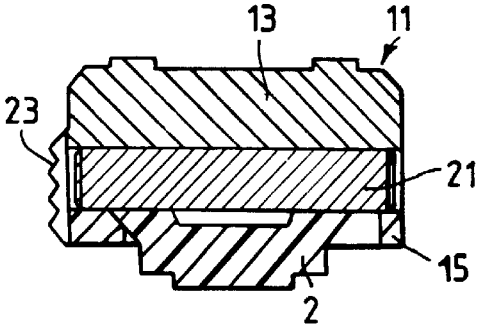
FIG. 7 is a section taken along line D—D of FIG. 2.
Figure 8:
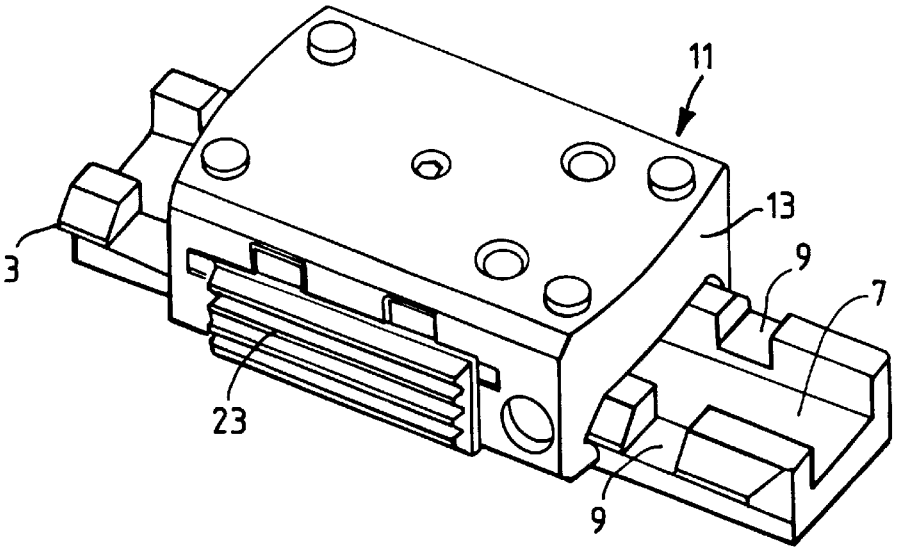
FIG. 8 is a perspective elevation view from an elevated, inclined viewpoint of the mounting apparatus of FIG. 1.

Each Figure shows the same mounting apparatus in various views. All common reference numbers throughout the drawing Figures represent common objects.

Generally, concepts such as "above", "forward", and the like, are based on the normal firing position of a weapon, with the shooting direction being horizontal. "Forward" indicates a direction in the shooting direction.

One example of a mounting apparatus constructed according to the teachings of the invention encompasses a rail 1 of plastic, which is preferably formed by an injection process and molded on a core of glass fiber reinforcement, or the like. The rail 1 has a substantial or massive underpart 2, which can have an approximately rectangular cross-section, and is mounted on the upper part of a weapon. The rail also has two upper parts 4, which are located on opposed sides of the underpart 2. Each upper part generally has a square cross-section portion which extends outward into an equilateral triangle portion. The exposed apex of this square-triangle extends outward and respectively forms longitudinal gripping edges or chamfers 3 and 5 which extend outward beyond the underpart 2.

Between the two upper parts 4, a longitudinal, upward opening groove 7 has been excised. This groove serves to save weight as well as to contribute to maintaining a somewhat equal wall thickness in the rail 1, so that casting faults are avoided. A plurality of cross grooves 9 are provided in the rail, transverse to its longitudinal axis. The grooves 9 extend through the upper part 4 of the rail and in depth, do not quite reach the bottom of the longitudinal groove 7. The shape of these transverse grooves 9 have the form of squat, horizontal rectangles.

The rail 1 extends from a position on the weapon above that part of the stock near to the breech up to a position above the forward end of the stock and, in this arrangement, is only secured or fastened at two places. At one of these two places the rail 1 is secured in all three coordinate directions. At the other place of securement the rail 1 is secured only in two coordinate directions similar to a bridge cantilevered with one end in abutment and the other end free. The advantage of such a construction is to allow heat expansion to occur relative to the weapon, without danger of component distortion.

A mounting base 11 is seated on the rail 1. The base 11 is comprised of a depressible part 15 and a fixed part 13. The fixed part 13 possesses on both ends, and respectively at both sides, a claw 17 and 19. The claws 17 and 19 are shaped complementary to the gripping chamfer 5 of the rail 1, and thus engage the chamfer 5. In this arrangement, one of the claws of the pair, for example, claw 17, is designed to be shorter in length (that is in the direction of the extension of the rail 1) than is the other claw, such as claw 19 in this example. The body of the claw is penetrated by a transverse pin 21, which pin, in the case of setting of the mounting base 11 on the rail 1, is driven in and engages in a cross groove 9 of the rail, with little or no play.

The depressible part 15, in a transverse direction, is slidably movable into the fixed part 13. The depressible part 15 extends beyond a longitudinal side of the fixed part 13, in this case, from the side of the gripping edge or chamfer 5. The depressible part 15 includes at that place a hand grip 23. The hand grip 23 protrudes from the side of the mounting base 11 and can be pressed by hand into the interior of the mounting base 11.

Two mutually opposing surfaces of the two parts 13 and 15 lie with the mounting base 11, between which two compression springs 25 are placed. A detent rod 27, which is driven into the fixed part 13, provides an abutment against the sliding depressible part 15, thus terminating travel of the part 15.

The depressible part 15 is pressed from an at-rest position, in which the hand grip 23 extends beyond the side of the fixed part 13. On the opposite side, on the depressible part 15, is placed a lateral, longitudinal web, projecting downward. In that side of the web, proximal to the rail 1, a gripping groove 29 is formed. This groove 29 is arranged to engage the complementary edge or chamfer 3. In the at rest situation of the depressible part 15, the gripping groove 29 can be pressed by the force of the compression springs against the edge 3 so that the mounting base 11 is then held essentially immovable on the rail 1. By pressing the handgrip 23 with the finger of one hand, which is opposed by another finger on the fixed part 13 or on the telescopic sight, which is mounted thereon, the gripping groove 29 can be moved out of contact with the gripping edge 3. Then the mounting base 11 can be removed from the rail 1. The same squeeze release is utilized for setting the mounting base 11 onto the rail 1.

The flat, upper surface of the mounting base 11 is designed for attachment of a sighting device such as a telescopic sight, or similar equipment.

The clamping of the mounting base 11 on the rail 1 is carried out with the force of the compression springs 25. Insofar as friction resulting from the clamping action does not suffice to hold the mounting base 11 in the longitudinal direction, the cross pin 21 serves to provide this retention force by engaging within one of the transverse grooves 9.

The length of the two claws 17 and 19 is about the same as the length of the engaging groove 29. The maximum surface pressure on the rail 1 arises from the shorter of these claw lengths, from the force of the springs 25, and as a consequence of the geometry of the gripping chamfers on edges 3 and 5 as well as the claws 17 and 19. This force is such that the plastic of the rail 1 experiences no deformation from the gripping of the claws 17 and 19 and the engagement groove 29. The chamfers 3 and 5 define a first attachment element provided as part of the rail 1. The groove 29 and the claws 17 and 19 define a second attachment element provided as part of the mounting base 11. The disclosed attachment elements can be reversed and provided on different components, can be replaced by alternative attachment element types, or can otherwise vary within the scope of the teachings of the invention.

In the case of the illustrated mounting base 11, the position or the alignment can be respectively so chosen such that the hand grip 23 lies to the left for a right handed marksman, or to the right for a left handed marksman. Thus, the handgrip 23 can be pressed by the thumb of the used hand, while the other hand holds the weapon underneath the forward stock.

A mounting apparatus for installing a telescopic sight, or the like, on a longitudinal structural rail placed or fabricated on a barreled weapon has been disclosed. The rail has an outwardly facing, longitudinal groove or a longitudinal projection on both sides into or onto which a removable mounting base, possessing a ridge or groove which is complementary for each of the sides of mounting base, can be slidingly inserted in an axial direction.

The disclosed mounting apparatus improves upon the known mounting apparatuses that were described above. Their advantages remain in force, but their disadvantages are substantially eliminated.

For example, in the case of a mounting apparatus that resembles EP 0 444 300 A2 (Repa) noted above, the mechanism for clamping in Repa is avoided. Instead, in the apparatus disclosed herein, the clamping force for securement of the two parts of the mounting base on of the invention to the rail is supplied by a spring arrangement. Further, the force of the spring, in regard to placement and removal of the mounting base to the rail, may be overcome by the fingers of the user, since the force need not exceed about 5 kg (11 lbs.).

An old tradition of more than a century is broken, wherein one of the securements of the traditional mounting base to the weapon must be absolutely form fit and axially transverse. This type of securement excluded relative displacement of the holder and the weapon in a transverse direction under all conditions. The disclosed mounting apparatus binds the mounting base with the rail by means of the complimentary engagement or attachment elements. The attachment elements maintain a gripping action only by the limited spring force, which is releasable by external effort. Relative positioning in a transverse manner is entirely possible.

A precondition of virtually every prior known mounting apparatus was that, under all circumstances, the retention of the telescopic sight on the weapon must be protected and continued. Following this design, if the weapon should fall from a highly placed blind, for instance, even though the stock might break off, the telescopic sight would remain in place and likely be damaged.

A substantial impact force against a telescopic sight, a night aiming telescope, or the like, is likely to cause damage. Thus, repair of the device is necessary and the damage precludes immediate reuse of the sighting device. An example would be, if a weapon with a traditionally mounted night aiming scope fell from a two meter height onto a paved street, with the prior constructions, the night-scope would be unavoidably damaged and yield no further images. It is better if the scope does not remain fastened onto the weapon. Using the apparatus disclosed herein, it is possible that the momentum of the falling night scope so loads the spring arrangement that the night scope apparatus is released from the weapon upon impact. Thus, when the apparatus is mounted as disclosed herein, then, upon dropping the weapon with the mounted scope, the scope may be protected because of release from the weapon. Alternatively, repair and replacement is simpler because of the quick release mounting apparatus.

Unlike prior devices, no long clamp-levers are necessary in the disclosed apparatus. Also, the considerable amount of precision in craftsmanship required for these prior devices is not required. This is because the spring arrangement disclosed herein has the capability of compensating for inexactness without difficulty. In any case, a set screw or the like is necessary in order to adjust the clamping force of the spring loading.

The mounting apparatus disclosed herein includes the form fit connection between the rail and the mounting base in order to prevent the base from slipping out as a result of external forces. In the case of the two prior known mounting apparatuses, as mentioned above, the mounting base is secured on the rail by a clamping action, such that it cannot be disengaged without damage.

In U.S. Pat. No. 3,887,166 (Ward), likewise, a form fit connection by means of a transverse bolt is taught, but this serves only to position the mounting base, not to retain the same against accidental axial sliding along the weapon. This sliding is sufficiently prevented, in the technology, by the tight clamping, so that in the Ward design, an additional form fit holding means is not required.

In the case of the disclosed apparatus, on the other hand, a projection on the mounting base engages in a form fit manner into a transverse groove of the rail, because the clamping action due to the force of the spring is not sufficient in every instance to prevent the mounting base from slipping from the weapon upon which it is carried. However, the spring force of the mounting apparatus disclosed herein, as a rule does suffice, to immovably hold a telescopic sight, or the like, on a weapon when the weapon is normally manipulated and used. A user will likely detect no difference between the mounting apparatus disclosed herein and a prior known mounting apparatus as mentioned previously. The exception to this is that the mounting base is clearly smaller, and a clamp-lever is absent resulting in simplified manipulation of the apparatus.

It is possible to construct on both sides of the rail, respectively, a projecting edge against which the two parts of the mounting base can engage with an outward directed force from the inside, since they are being held apart by the force of the spring. Extensions of these parts, which can be held by the fingers of the user, need only be pressed together for their removal. At least one chamfer on the two parts can ensure that the mounting base, while being attached, need only be pressed against the rail. The chamfers engaging into the edges of the rail, press the two parts of the mounting base together, thus overcoming the force of the spring. In a trough-like rail, designed in this way, dirt can easily collect, especially if it is horizontally mounted on the upper side of the weapon.

With this in mind, the two side edges of the rail are held by encasement from the outside, since otherwise, an insufficient seating on the rail would result. The force of the spring loads the two parts of the mounting base against one another. Additionally, in the spring arrangement, a sliding part is run into a fixed part, and the sliding part extends beyond the side of the fixed part to form a hand grip. If one finger presses on this hand grip, while another finger braces the fixed part, then the force of the spring is overcome and the two engaging edges (with respectively a groove or a ridge) are moved away from the complementary side edges of the rail (with respectively a ridge or a groove).

Further, the sliding part provided with the hand grip, is designated as a depressible part, while the other part is designated a fixed part. Pushing the depressible part into the fixed part assures that a mounting base, constructed of two parts, can be sufficiently longitudinally stable.

A particularly simple design of part of the mounting base is the transverse pin that can be round in cross section. In the case of a mounting base being set in place, the pin extends parallel to a cross groove and seats therein. This arrangement allows placing the transverse pin in the depressible part. It is, however, more practical to place the transverse pin in the fixed part of the mounting base. For such an arrangement of the pin, the danger does not exist that movement of the depressible part is prevented by the impingement of the transverse pin on the cross groove.

In one example, the transverse pin is placed next to the depressible part, so that when viewed in the longitudinal axial direction of the rail, either before or behind the depressible part, the transverse pin does not need to penetrate the depressible part.

In the case of a hunting weapon used by an individual marksman with only a single telescopic sight, it may suffice to place only one transverse groove in the rail, as this is taught by the Ward patent. In the case of the disclosed mounting apparatus, however, several cross grooves are designed into the rail. Thus, the mounting base with the transverse pin can be set into the most appropriate, respective cross groove. In this way, it is possible to arrange the telescopic sight or other sighting device at an optimal distance from the eye, such as when the marksman is wearing a thick safety vest, winter clothing, and/or glasses or safety eyewear.

Optional other sighting devices and apparatuses can be obtained and used for the same weapon, such as a night sight telescope, a laser aiming device, a sighting telescope for special munitions, a grenade launcher, or the like. These, in accord with length and weight, possess one or more mounting bases and, with the transverse pin of one or another mounting base, can be placed respectively in an appropriate cross groove of the rail.

In a further example, it can be advantageous to extend the rail forward, somewhat toward the end of the forward stock, or even all the way to the muzzle. An optical or illuminated bead can likewise be set in place. Also, entire combinations of optical telescope sights and image enhancers or image transducers can be set in place to provide a high capacity aiming device for night use or to have at hand an infrared night scope. These often lengthy constructed pieces of equipment can then be attached with two or more mounting bases. Where this is the case, the attachment by means of a chamfer on the under edge of the depressible part is facilitated, in that the engaging edge is proximal to the rail. While mounting, the aiming equipment need only to be pressed against these edges. In any case, for the removal of each mounting base, only one hand is necessary to depress the depressible part into the fixed part of the mounting base.

It is, however, possible to augment the depressible part with a capture device or a retainer in order to keep it in the depressed position. In such a case, the chamfer is not required.

For several decades, pressure cast molding has been used to manufacture precision parts for weapon construction. In this process, either zinc (because of its low melting point and sufficient structural strength) or plastics are very often used. It would likewise be economically manufacture at least the rail out of the same material. The materials, however, have the inherent disadvantage that they yield under too high a pressure.

If a steel pin is sized to press fit in a bore of a zinc workpiece, a day later, without any trouble, the pin can be easily removed from the bore, because it occupies only a light transition or interference fit therein. The material in this example has recrystallized to the point that the crystalline matrix, under tension, has reoriented. Mounting apparatuses of prior known constructions with a rail made of plastic or zinc are scarcely useable because of this material characteristic. With these prior constructions, it is practically unavoidable that use of an extreme clamping force acting on the material of the rail will cause the material of the components to yield.

Under these circumstances, a plastic rail on a weapon would be of particular advantage if the rail extends at least beyond approximately the length of the forward stock, more or less to form a device carrier for universal application. A plastic rail can also be lighter in weight than a light metal rail.

Nevertheless, and in a surprising manner, the mounting apparatus described herein makes possible the use of either zinc or plastic for the rail. The reason for this is that the spring force that biases together the parts of the mounting base and the rail can be strictly controlled and designed. Even in cases of unfavorable tolerances and inaccurate adjustment, the force of the spring that supplies the clamping action remains somewhat at the same magnitude. A clamping based on threaded engagement, on the other hand, when the adjustment is inexact, can cause a substantial increase of the clamping force, which can lead to stripped threads, a loose screw, or pulling out of the clamping screw. The prerequisite is the spring arrangement that can change its spring force somewhat linearly to the spring travel, and does so only in a small amount. This is in contrast to the plate spring as presented in EP 444 300 A2 (Repa) noted above. A spring arrangement of one or two prestressed, helical compression springs of wire have proven well in service.

In order to avoid excessive surface pressures that can cause damage to the parts, the dimensions of the various components do not all have to be small and, as a rule, can be greater than in prior mounting apparatuses. For example, as to the width of the rail, when made of plastic and measured transverse to the longitudinal axis of the weapon, and specifically, the distance between the two gripping edges, a dimension of 20 to 25 mm has proven effective. The length of the gripping section of the mounting base can be about the same. The material of the mounting base is, in one other preferred example, light metal, perhaps an aluminum alloy, since such metal, when subjected to the load of the spring arrangement, can transmit higher surface pressures than are allowable for plastic or zinc. Other materials can also be used without departing from the spirit and scope of the invention.

Although certain apparatuses constructed in accordance with the teachings of the invention have been described herein, the scope of coverage of this patent is not limited thereto. On the contrary, this patent covers all embodiments of the teachings of the invention fairly falling within the scope of the appended claims, either literally or under the doctrine of equivalents.

What is claimed is:

1. A mounting apparatus for attaching a sighting device onto a weapon, the mounting apparatus comprising:

a rail disposed on part of the weapon in a longitudinal direction, the rail having a pair of longitudinally extending opposed sides and a longitudinally extending first attachment element on each of the opposed sides;

a removable mounting base having a pair of longitudinally extending side edges and a longitudinally extending second attachment element on each side edge, each second attachment element being complimentary to a corresponding one of the first attachment elements, the mounting base slidingly and longitudinally engaged with the rail via the complimentary first and second attachment elements, wherein the mounting base is formed of at least two parts which are linearly slidable against one another in a transverse direction; and a spring mechanism providing a spring force and arranged to bias the two parts of the mounting base into engagement with the rail, wherein the spring force is overcome by manually squeezing the two parts to release the mounting base from the rail.

2. A mounting apparatus according to claim 1, wherein the sighting device is selected from a group of devices including at least a telescopic sight, an infrared sight, a night sight telescope, a laser aiming device, a sighting telescope for special munitions, and a grenade launcher sight.

3. A mounting apparatus according to claim 1, wherein the first attachment element is a chamfer provided on each of the opposed sides of the rail and the second attachment device is a complimentary groove provided on one side edge of the mounting base and at least one complimentary claw provided on the other side edge of the mounting base.

4. A mounting apparatus according to claim 1, further comprising:

at least one recess in a portion of the rail; and a projection disposed on a side of the mounting base proximal to the recess, wherein the projection engages the recess upon attachment of the mounting base to the rail.

5. A mounting apparatus according to claim 4, wherein the recess of the rail is constructed as a transverse groove, and wherein the projection of the mounting base is a cross pin secured in a fixed part of the mounting base and is installed to engage in the transverse groove of the rail.

6. A mounting apparatus according to claim 1, wherein the mounting base clampingly engages the rail from outside the opposed sides of the rail, and wherein one of the two parts of the mounting base is partially received inside the other of the two parts and can be depressed therein upon overcoming the spring force of the spring.

7. A mounting apparatus according to claim 6, further comprising:

at least one transverse groove in a portion of the rail;

a cross pin disposed on a side of the mounting base proximal to the recess, wherein the cross pin engages the transverse groove upon attachment of the mounting base to the rail, and wherein the cross pin is positioned beside the depressible one part.

8. A mounting apparatus according to claim 1, wherein the rail includes a plurality of cross grooves.

9. A mounting apparatus according to claim 1, wherein the rail extends over a substantial part of the weapon.

10. A mounting apparatus according to claim 9, wherein the weapon is a rifle having at least a forward stock, and wherein the rail extends up to a front end of the forward stock.

11. A mounting apparatus according to claim 1, wherein the rail is made of a material selected from a group of materials comprising at least zinc and plastic.

12. A mounting apparatus according to claim 1, wherein the rail is constructed as an integral part of the weapon.

13. A mounting apparatus according to claim 1, wherein the rail is constructed as a discrete separate component and is subsequently secured to a part of the weapon.

* * * * *